US010674758B2

(12) United States Patent
Schmidt

(10) Patent No.: US 10,674,758 B2
(45) Date of Patent: Jun. 9, 2020

(54) METHOD FOR UNWINDING A BOBBIN OF A COILED SHEET AND UNWINDING APPARATUS FOR UNWINDING A BOBBIN

(71) Applicant: PHILIP MORRIS PRODUCTS S.A., Neuchatel (CH)

(72) Inventor: Johann Schmidt, Mindelau (DE)

(73) Assignee: Philip Morris Products S.A., Neuchatel (CH)

( * ) Notice: Subject to any disclaimer, the term of this patent is extended or adjusted under 35 U.S.C. 154(b) by 196 days.

(21) Appl. No.: 15/768,064

(22) PCT Filed: Oct. 7, 2016

(86) PCT No.: PCT/EP2016/074090
§ 371 (c)(1),
(2) Date: Apr. 13, 2018

(87) PCT Pub. No.: WO2017/063958
PCT Pub. Date: Apr. 20, 2017

(65) Prior Publication Data

US 2018/0343915 A1 Dec. 6, 2018

(30) Foreign Application Priority Data

Oct. 13, 2015 (EP) ..... 15189520

(51) Int. Cl.
*A24C 5/20* (2006.01)
*A24C 5/00* (2020.01)
(Continued)

(52) U.S. Cl.
CPC ..... *A24C 5/005* (2013.01); *A24C 5/20* (2013.01); *B65H 16/04* (2013.01); *B65H 16/103* (2013.01); *A24B 3/14* (2013.01); *B65H 2301/415185* (2013.01); *B65H 2301/441* (2013.01); *B65H 2515/50* (2013.01); *B65H 2801/54* (2013.01)

(58) Field of Classification Search
CPC ..... A24C 5/005; A24C 5/20; B65H 16/04; B65H 16/103; B65H 2801/54; B65H 2515/50; B65H 2301/441
See application file for complete search history.

(56) References Cited

U.S. PATENT DOCUMENTS 5,203,354 A 4/1993 Hickle
5,520,738 A * 5/1996 Aindow ..... A24C 5/005 118/621

(Continued)

OTHER PUBLICATIONS

PCT Search Report and Written Opinion for PCT/EP2016/074090 dated Jan. 30, 2017 (11 pages).

*Primary Examiner* — Sang K Kim
(74) *Attorney, Agent, or Firm* — Mueting Raasch Group

(57) ABSTRACT

The present invention relates to a method for unwinding a bobbin of a coiled sheet, the method comprising: ○providing a bobbin of a coiled sheet, the bobbin comprising a free portion of the sheet unwound from the bobbin; ○arranging a blade between the free portion of the sheet and the remaining of the sheet coiled in the bobbin in such a way that the blade is in contact to the sheet coiled in the bobbin; and ○vibrating the blade while unwinding the sheet from the bobbin. The present invention also relates to an unwinding apparatus for unwinding a bobbin.

17 Claims, 4 Drawing Sheets

(51) Int. Cl.

| | |
|---|---|
| ***B65H 16/04*** | (2006.01) |
| ***B65H 16/10*** | (2006.01) |
| *A24B 3/14* | (2006.01) |

(56) References Cited

U.S. PATENT DOCUMENTS

| | | | | |
|---|---|---|---|---|
| 2002/0154205 | A1* | 10/2002 | Kaya ..... | B65H 19/105<br>347/177 |
| 2004/0237980 | A1 | 12/2004 | Holmes | |
| 2013/0161369 | A1 | 6/2013 | Chen | |

* cited by examiner

METHOD FOR UNWINDING A BOBBIN OF A COILED SHEET AND UNWINDING APPARATUS FOR UNWINDING A BOBBIN

This application is a U.S. National Stage Application of International Application No. PCT/EP2016/074090, filed Oct. 7, 2016, which was published in English on Apr. 20, 2017, as International Publication No. WO 2017/063958 A1. International Application No. PCT/EP2016/074090 claims priority to European Application No. 15189520.8 filed Oct. 13, 2015.

The present invention is related to a method and an apparatus to unwind a bobbin of coiled sheet. In a specific embodiment, the method and the apparatus are directed to the unwinding of homogenized tobacco material bobbins.

Unwinding bobbins of material can be a difficult task, when the material which is coiled to form a bobbin is at the same time both sticky, so a rather high force need to be applied in order to unwind it, and fragile, so that it can be easily torn apart. Such a material is for example homogenized tobacco sheet, which can be obtained for example casting a sheet of homogenized tobacco material. The homogenized tobacco sheet, when coiled in bobbins, is difficult to unwind due to its consistency, sensitivity to heat and low tensile strength, all preventing for instance to simply increase the force applied to the sheet to unwind the bobbin.

In current manufacturing process of homogenized tobacco material, unwinding speed has to be lowered sometimes down to about 100 meters per minute in order to prevent as much as possible to tear the homogenized tobacco sheet, which in turn automatically decreases the production speed and hourly production.

In addition to the low tensile strength of the material, some bobbins of homogenized tobacco sheet have quite variable shapes from one to another, so this shape inhomogeneity has to be taken into account in an apparatus and a method to unwind bobbins of homogenized tobacco sheet.

There is therefore a need of a method and an apparatus to unwind bobbins of coiled sheet, in particular of sheets of material having low textile strength. These method and apparatus should be capable to increase the unwinding speed so that the rest of the production line can increase the overall production rate. Further, the method and the apparatus should take into account adjustments in position due to the different bobbin shapes as well as due to the unwinding of the bobbins.

In a first aspect, the invention relates to a method for unwinding a bobbin of a coiled sheet, the method comprising: providing a bobbin of a coiled sheet, the bobbin comprising a free portion of the sheet unwound from the bobbin; arranging a blade between the free portion of the sheet and the remaining of the sheet coiled in the bobbin in such a way that the blade is in contact to the sheet coiled in the bobbin; and vibrating the blade while unwinding the sheet from the bobbin.

As used herein, the term "sheet" denotes a laminar element having a width and length substantially greater than the thickness thereof. The width of a sheet is preferably greater than 10 millimeters, more preferably greater than 20 millimeters or 30 millimeters. Even more preferably, the width of the sheet is comprised between about 100 millimeters and 300 millimeters.

In a preferred embodiment, the sheet is a sheet of homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material is then rolled in bobbins which needs to be unwound in order to be further processed, to be part for example of an aerosol-forming article, that is to be included in the aerosol-forming substrate of the aerosol-forming article. In a "heat-not-burn" aerosol-generating article, an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol-generating article. This means that the aerosol composition that is generated by such a "heat-not-burn" aerosol-generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition leads to a sheet which is "sticky", that is, it glues to adjacent objects, and at the same time it is rather fragile having a relatively low tensile strength.

The present invention is especially adapted to unwind bobbins made of homogenized tobacco material as defined above, however it can be applied as well in any process wherein a sheet having such characteristics need to be unwound from a bobbin.

The bobbin shape can be any. It can have a substantially cylindrical shape, however an oval or anyhow deformed shape, such as a bobbin with bulges deforming a underlying cylindrical shape, do not hinder the application of the teaching of the invention.

In order to properly unwind the bobbin, keeping in mind its stickiness and fragility and thus minimizing breakage but at the same time keeping a relatively high unwinding speed, a blade is put into contact with the sheet coiled in the bobbin, between a free end of the sheet already unwound from the bobbin and the remaining of the bobbin itself.

The blade in contact to the bobbin is then put into vibrations. Thanks to the vibrations of the blade, the unwinding of the sheet becomes much easier than without the vibrations themselves.

Indeed, less force is required to pull a free end of the sheet in order to unwind it from the bobbin when the vibrations are present. Once in position, the blade preferably applies vibrations substantially at the very specific location where the sheet is being unwound from the bobbin, transferring to the sheet being unwound from the bobbin but still stuck to it, a controlled amount of force related to the frequency and amplitude of the vibrations. This amount of force is applied to a limited portion of the sheet, that is, it is applied on an area of contact between the blade and the bobbin, which is relatively limited. In a non limiting example, the blade has a width at the contact area between blade and bobbin of between about 100 millimeters and about 300 millimeters, and a thickness at the contact area comprised between about 2 millimeters and about 6 millimeters. The defined contact area between the blade and the bobbin is relatively "small" and its dimensions are substantially the same of those of the blade at the contact area.

Preferably, the vibrations of the blade are applied on the bobbin in such a way that the direction of the vibrations of the blade is preferably perpendicular to the direction of the unwinding of the bobbin. The blade is therefore moving "back and forth" in a direction which is substantially perpendicular to the direction in which the free end of the bobbin is pulled.

Advantageously, the amplitude of the vibrations of the blade is preferably comprised between about 0.01 millimeters and about 2 millimeters, more preferably between about 0.1 millimeters and about 1 millimeter.

Therefore, thanks to the vibrating blade, this force or pressure applied to the bobbin makes the unwinding process easier and the speed of unwinding can be increased with respect to the prior art solutions without the risk of breaking the sheet.

Advantageously, the method includes a step of applying pressure on the bobbin in a contact region between the blade and the sheet coiled in the bobbin. Preferably, the applied pressure in the contact region or contact area is of about between 0.5 kilograms and 1 kilogram on a surface equal to the contact area above defined, for example on an area of about between 0.5 millimeters and about 3 millimeters in thickness and 150 millimeters in width. The blade is substantially abutted to the sheet wound in the bobbin and the blade applies a given pressure onto the sheet still coiled in the bobbin. The presence of this applied pressure, that is, of a given force on a "small" well defined contact area pushing the blade towards the bobbin, is preferred in order to correctly transfer vibrations from the blade to the sheet.

Preferably, the method further includes the step of pulling the free portion of the sheet while unwinding the bobbin. In this way, the bobbin is unwound gently pulling the free end of the sheet from the bobbin while vibrations are applied to an area—the contact area—of the sheet still coiled in the bobbin. Due to the vibrations' presence, the pulling force is lower than without vibrations.

Preferably, the step of applying pressure comprises: shifting the blade towards the bobbin when a dimension of the bobbin is reduced due to the unwinding. This shifting is preferably performed in order to apply substantially a constant force or pressure to the bobbin during the unwinding process. Without shifting the blade, at a certain point, due to the reduction in size (for example, in diameter) of the bobbin itself during unwinding, the contact between the blade and the sheet in the bobbin would be lost. In addition, the possibility of shifting the blade towards or away from the bobbin may compensate for deformations or bulges in the bobbin's shape. Due to this shifting, regardless of the bobbin overall geometry, the force or pressure on the bobbin exerted by the blade remains substantially constant within a tolerance interval during the whole unwinding process.

Advantageously, the step of vibrating the blade comprises vibrating the blade at a frequency comprised between about 10 kilohertz and about 100 kilohertz, more preferably between about 20 kilohertz and about 60 kilohertz, even more preferably between 30 kilohertz and 35 kilohertz. This has been found to be the frequency range which allows the best compromise between having a rather "high" speed of unwinding on one hand and minimizing the number of breakages of the sheet due to the unwinding tearing force on the other hand.

Preferably, the step of arranging the blade comprises: providing a blade having an edge portion; and arranging the blade so that the edge portion of the blade is substantially tangential to the sheet coiled in the bobbin at a contact region between the edge portion and the sheet coiled in the bobbin. The blade has a "tip" or edge which is in contact to be bobbin and defines an area of contact between the bobbin and the blade, that is, the area or region of contact is the area of abutment of the blade on the bobbin. Preferably this area of contact is a stripe of rather narrow width, that is, preferably having a thickness dimensions comprised between about 2 millimeters and about 6 millimeters. Preferably, the edge of the blade is "sharp". The blade edge portion has advantageously a substantially planar configuration, for example it includes a planar surface, so that a blade plane is defined. The blade plane passes through the edge of the blade in contact to the bobbin and extends along a longitudinal extension of the blade. The blade plane is preferably arranged substantially along a tangential plane to the bobbin on the line of intersection between the edge of the blade and the bobbin itself. The line of intersection is in reality an area, the contact area, however due to its rather limited dimensions, in particular due to its rather limited thickness, it may be considered as a line. It is considered that the blade plane and the bobbin are substantially tangential when the angle formed by such a blade plane and the tangential plane is of about 0°+/−10°, more preferably of about 0°+/−5°, even more preferably of about 0°+/−2°, preferably 0°+/−1°. More preferably, not only the blade edge is planar, that is, it includes a planar surface, but the blade as a whole defines a planar surface. The planar surface defines the blade plane. The blade and the bobbin are said to be tangential when the angle formed between the blade plane and the tangential plane at the area of contact between the blade edge and the bobbin is of about 0°+/−10°, more preferably of about 0°+/−5°, even more preferably of about 0°+/−2°, preferably 0°+/−1°.

According to a second aspect, the invention relates to an unwinding apparatus for unwinding a bobbin, the apparatus comprising: a bobbin holder where a bobbin of a coiled sheet is placed; a blade arranged in front of the bobbin holder and adapted to be in contact to the sheet coiled in the bobbin; and a vibration generator connected to the blade and adapted to put the blade into vibrations while the sheet is unwinding from the bobbin. Advantages of such an apparatus have been already discussed with reference to the first aspect of the invention and are not herewith repeated.

Preferably, the vibration generator is an ultrasonic generator adapted to generate vibrations of the blade between about 10 kilohertz and about 100 kilohertz, more preferably between about 20 kilohertz and about 60 kilohertz, even more preferably between 30 kilohertz and 35 kilohertz. This is the preferred frequency in order to obtain a "fast" and "safe" unwinding. In the present case, the unwinding speed obtained with the method of the invention is preferably of between about 50 meters per minute and about 300 meters per minute.

Preferably, the blade comprises an edge portion adapted to contact the sheet coiled in the bobbin, the edge portion comprising a first and a second surfaces forming an angle therebetween of about 12°±10°. Preferably the surfaces are substantially rectangular and identical to each other. The blade is thus preferably symmetrical with respect to a longitudinal plane. The selected angle allows having a small contact area between the bobbin and the blade. The blade comprises a body portion adapted to face a free portion of the sheet unwound from the bobbin, the body portion comprising a first and a second surfaces forming an angle therebetween of about 2°±1°. A small angle of the blade outside the edge portion allows keeping the overall dimensions of the blade rather limited, at least in one direction, so that it is easy to insert the blade between the free end of the sheet and the remaining of the bobbin and to avoid accidental contact between the blade and the unwinding free end of the sheet.

The unwinding apparatus of the invention preferably also comprises a position adjustment system, adapted to change the position of the blade with respect to the bobbin holder depending on a dimension of the bobbin present in the holder. The apparatus thus preferably adapts to any bobbin size or shape and it can be used with different types of bobbins without the need to redesign the unwinding apparatus itself.

More preferably, the unwinding apparatus comprises a control unit connected to the position adjustment system and adapted to command the position adjustment system to move the blade towards the bobbin as the dimension of the bobbin reduces due to unwinding. In this way, a substantially constant pressure or force can be applied on the bobbin by the blade at the area of contact.

More preferably, the position adjustment system includes a rail wherein a support of the blade can slide towards and moving away from the bobbin holder, and a weight to pull the support towards the bobbin holder by gravity. In this way, in a rather simple mechanism, a constant force or pressure may advantageously be applied to the bobbin, triggered by the weight that pulls the blade towards the bobbin by gravity.

More preferably, the vibration generator, connected to the blade, is coupled to the rail so as to slide therein.

Preferably, the blade is made of polytetrafluoroethylene or comprises a polytetrafluoroethylene coating. The polytetrafluoroethylene, better known for instance with the tradename of Teflon®, is a non-sticky composition, which can be used as a coating as well, which may allow the blade to substantially glide over the sheet while the bobbin is rotating, so that it may be avoided that the blade is "glued" to the sheet itself due to the sticky properties that the sheet may have.

Preferably, the apparatus comprises an arm connecting the vibration generator and the blade, the arm having a U-shaped form. An U-shaped arm may allow a simple but optimal construction where the unwinding sheet is not hindered in its movement by the arm presence. The arm—due to its U-shape—advantageously leaves room for movements to the unwinding sheet.

Advantageously, the blade is arranged to be in contact to the sheet coiled in the bobbin substantially tangential to the sheet coiled in the bobbin at a contact region between the blade and the sheet coiled in the bobbin. Advantages of this arrangement have been already set forth with reference to the first aspect of the invention.

Further advantages of the invention will become apparent from the detailed description thereof with no-limiting reference to the appended drawings.

Figure 1:
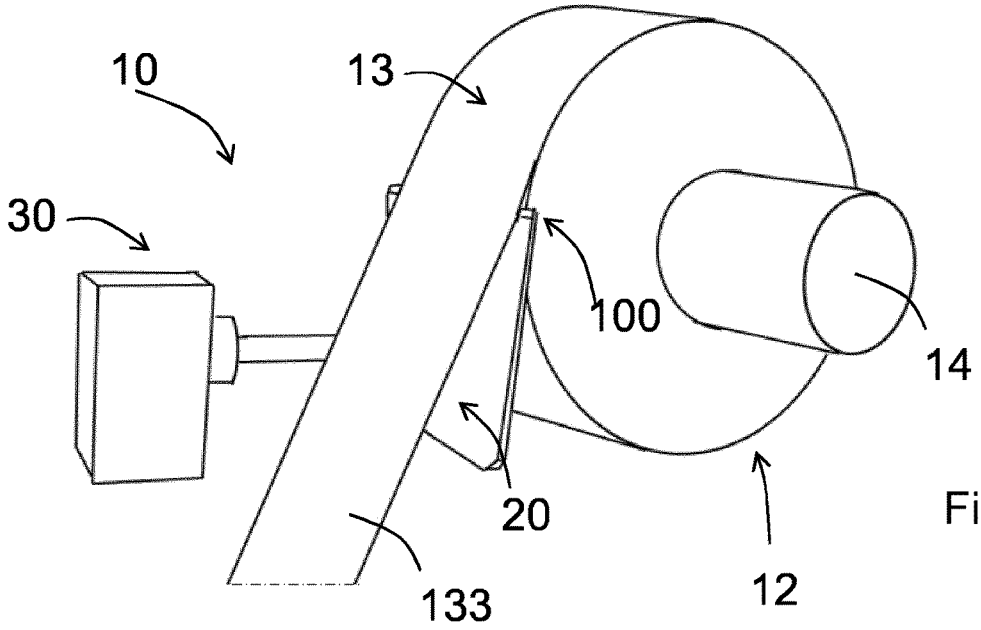
FIG. 1 is a schematic perspective view of an unwinding apparatus according to the invention for unwinding a bobbin.

With reference to the figures, an unwinding apparatus for unwinding a bobbin according to the present invention is represented and indicated with reference number 10.

The apparatus 10 is adapted to unwind a bobbin 12.

For instance, the bobbin 12 can be a homogenized tobacco material bobbin. However, the invention can be applied to all industries where manufacturing processes include the unwinding of bobbins having sticky and fragile sheets, for instance, paper industry or industry using polymer sheets coiled in bobbins.

The bobbin 12 shown in the figures has a round, for example cylindrical, shape. However, the invention works fine with bobbins even when the bobbins do not have round shape.

The apparatus 10 comprises a bobbin holder 14 where the bobbin 12 is placed.

The bobbin 12 is formed by a coiled sheet 13. The apparatus 10 is adapted to unwind the coiled sheet 13 of the bobbin 12, as shown in FIG. 1.

The apparatus 10 also comprises a blade 20 and a vibration generator 30.

The blade 20 is arranged in front of the bobbin holder 14 and is adapted to be in contact to the sheet 13 coiled in the bobbin 12. The blade 20 is preferably made of polytetrafluoroethylene (for instance Teflon®) or is made of metal material and comprises a polytetrafluoroethylene coating. In this way, the sheet 13 (in particular, the homogenized tobacco material sheet) is protected both from friction which could lead to tearing and from heat which could damage or modify a component of the sheet (in particular, the homogenized tobacco material sheet).

Figure 3:
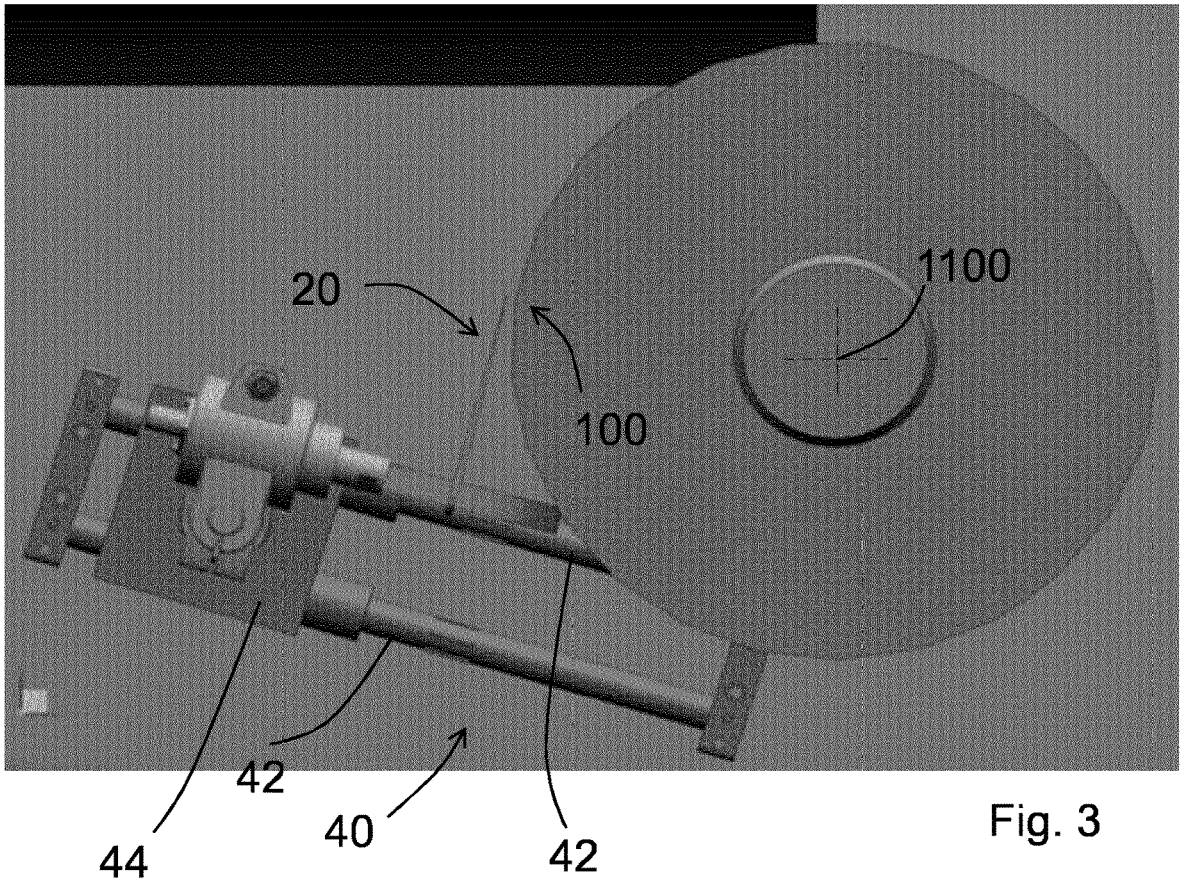
FIG. 3 is a lateral view of the unwinding apparatus of FIG. 2.

The blade 20 is arranged to be in contact to the sheet 13 coiled in the bobbin 12 substantially tangential to the sheet 13 coiled in the bobbin 12 at a contact region 100 between the blade 20 and the sheet 13 coiled in the bobbin 12 (see FIGS. 1 and 3). In a non-limiting preferred embodiment, the contact region is substantially rectangular and it has a dimension of about 4 millimeters by about 120 millimeters. Due to its limited thickness, this contact area can be considered as a "line".

Figure 7:
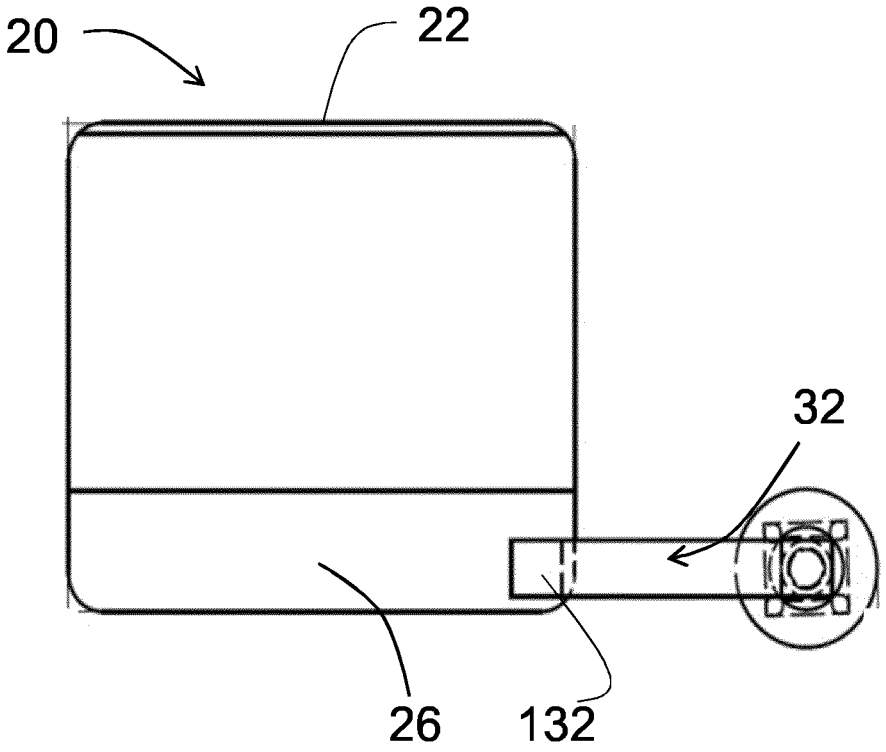
FIG. 7 is a front view (taken from the right of FIG. 5) of the portion of the unwinding apparatus of FIG. 5.

According to the non-limiting shown embodiment, the blade 20 includes a body portion 24 terminating at one end portion 22 with a sharp edge. The blade 20 is substantially rectangular when seen in a plan view, as shown in FIG. 7. For instance, its dimensions are of about 150 millimetres in width, about 130 millimetres in length and about 4 millimetres in thickness on average.

Figure 5:
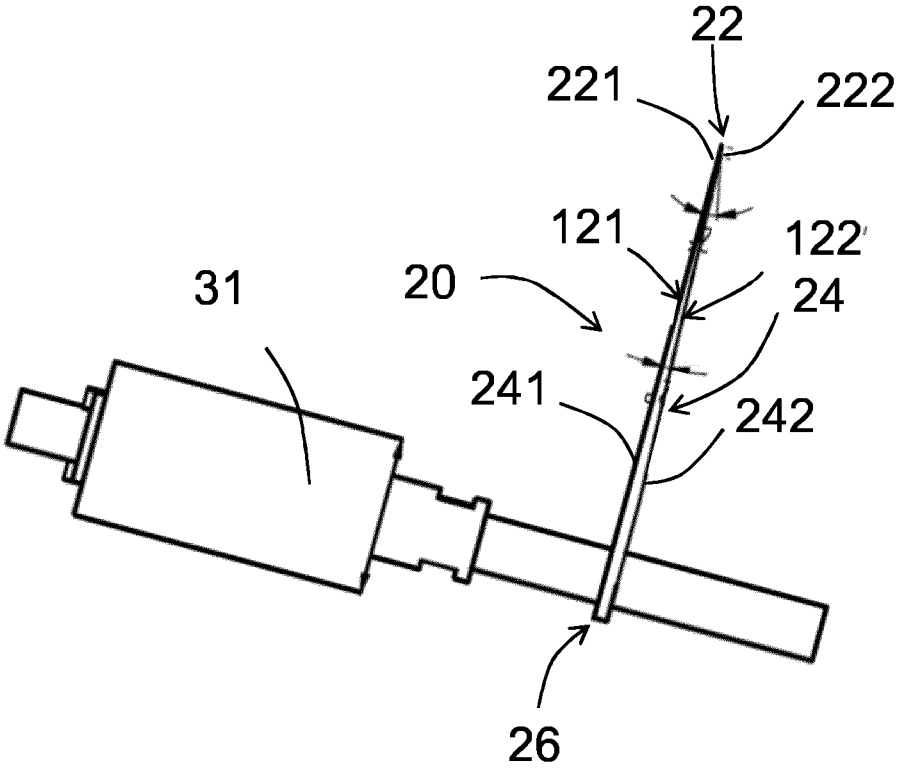
FIG. 5 is an enlarged lateral view of a portion of the unwinding apparatus of FIG. 3.

Preferably, as better visible in FIG. 5, the blade thickness is not constant but is biased with a predetermined slope (for instance, a slope of about 2°) from a first end portion 26 connected to the vibration generator 30 to the end portion 22 (second end portion 22) in contact with the bobbin 12. Furthermore, on the second end portion 22 in contact with the bobbin 12, the slope increases (for instance to about 12°) so that the second end portion 22 is sharp defining the blade edge. For instance the second end portion 22 has a thickness of about 3 millimetres±1 millimetres.

More in particular, the second end portion 22 is adapted to contact the sheet 13 coiled in the bobbin 12. The second end portion 22 is defined by opposite, substantially flat first and second surfaces 221, 222. The first and second surfaces 221, 222 form an angle therebetween of about 12°±5°.

Figure 4:
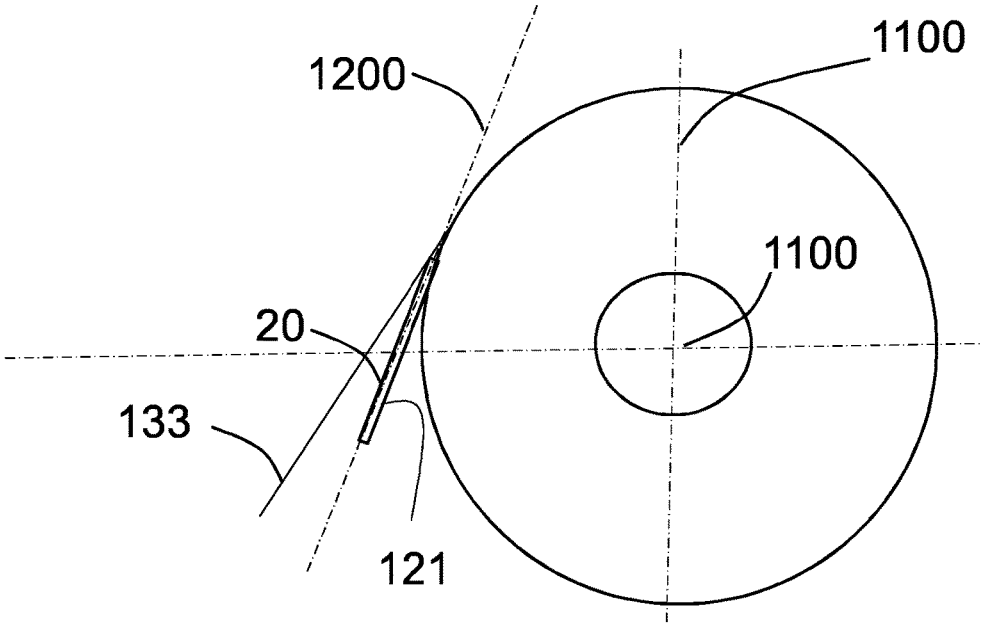
FIG. 4 is a schematic view of part of FIG. 3.

The body portion 24 is adapted to face a free portion 133 of the sheet 13 unwound from the bobbin 12. The body portion 24 is defined by opposite, substantially flat first and second surfaces 241, 242. The first and second surfaces 241, 242 form an angle therebetween of about 2°±1°. The first surface 221 of the second end portion 22 and the first surface 241 of the body portion 24 are arranged on the same side 121 of the blade 20. This first side 121 is that opposite with respect to the bobbin holder 14 (see FIGS. 3-5). The first surface 221 of the second end portion 22 and the first surface 241 of the body portion 24 are substantially coplanar (see FIG. 5). In other words, the first side 121 defines a blade plane.

The second surface 222 of the second end portion 22 and the second surface 242 of the body portion 24 are arranged on the same second side 122 of the blade 20. This second side 122 is that facing the bobbin holder 14 (see FIGS. 3-5).

Figure 2:
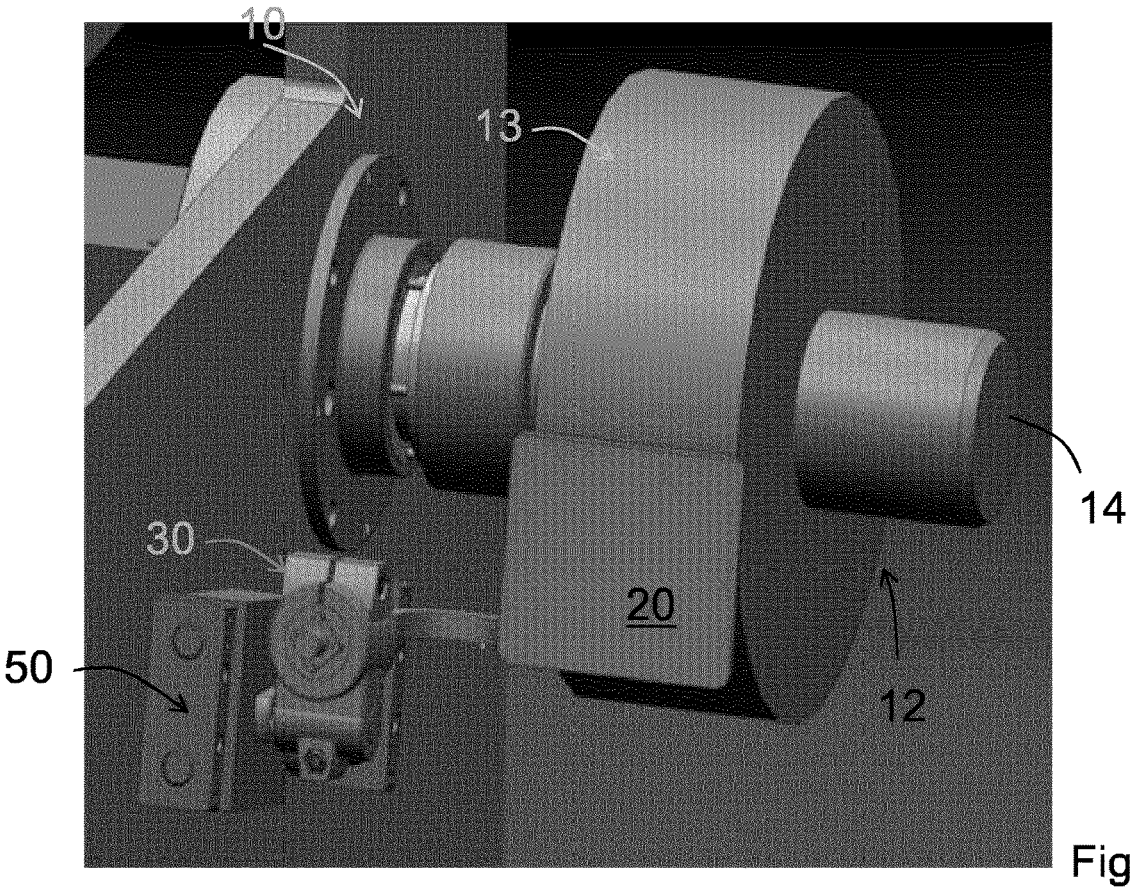
FIG. 2 is a further schematic perspective view of the unwinding apparatus of FIG. 1, taken from a different view point.

The apparatus 10 comprises a position adjustment system 40, shown in FIGS. 2 and 3. The position adjustment system 40 is adapted to change the position of the blade 20 with respect to the bobbin holder 14 depending on a dimension of the bobbin 12 present in the holder 14.

The apparatus 10 comprises a control unit 50 connected to the position adjustment system 40 and adapted to command the position adjustment system 40 to move the blade 20 towards the bobbin 12 as the dimension of the bobbin 12 reduces due to unwinding.

The position adjustment system 40 includes a rail 42 wherein a support 44 of the blade 20 can slide towards and moving away from the bobbin holder 14. Preferably, the support 44 slides on a pair of parallel rails 42 (see FIG. 3).

The position adjustment system 40 further includes a weight (not shown) to pull the support 44 towards the bobbin holder 14 by gravity.

Indeed, the rails 42 are not horizontal but are oriented towards the bobbin holder 14 with a predetermined slope angle downwards. In other words, the rails go downwards toward a center 1100 of the bobbin 12 and the support 44 slides downwards along the rails due to gravity. The above-mentioned weight is attached to the support 44 of the position adjustment system 40 to pull it toward the bobbin 12.

In this way, the position adjustment system 40 also defines a predetermined slope angle of the blade 20 with respect to a vertical direction. In other words, with reference to FIGS. 3 and 4, the blade 20 is not vertically oriented (that is, oriented as a vertical plane 1000 passing through the center 1100 of the bobbin holder 14 and therefore of the bobbin 12) but has a predetermined slope angle with respect to the vertical direction.

Preferably, the blade 20 is substantially tangentially oriented with respect to the bobbin 12 in the area of contact between the blade 20 and the bobbin 12. In other words, with reference to FIGS. 3 and 4, the blade 20 is substantially oriented as a plane 1200 tangent to the bobbin 12 and passing through a contact line between the sharp edge of the blade 20 and the bobbin 12.

More precisely, the blade 20 has a substantially planar configuration and the first side 121 defines the blade plane, as detailed above. The blade plane passes through the sharp edge of the blade 20 and is extended along a longitudinal extension of the blade 20. The first side 121 of the blade 20 is arranged substantially along a tangential plane to the bobbin 12 on the line of intersection between the edge of the blade 20 and the bobbin 12 itself. It is considered that the first side 121 of the blade 20 and the bobbin 12 are substantially tangential when the angle formed by the first side 121 and the tangential plane 1200 forms an angle of 0°+/−10° (see FIG. 4).

The position adjustment system 40 can use other systems (not shown). For instance, a proximity sensor capturing the distance from to the bobbin 12 can be provided. In this case, the proximity sensor is coupled with the support 44 which is suitably motorized.

The vibration generator 30 is connected to the blade 20 and adapted to put the blade 20 into vibrations while the sheet 13 is unwinding from the bobbin 12.

The vibration generator 30 is preferably an ultrasonic generator adapted to generate vibrations of the blade between about 30 kilohertz and about 35 kilohertz.

The vibration generator 30 comprises a motor 31 generating the vibrations.

The vibration generator 30 is connected to the blade 20 and is coupled to the rail 42 so as to slide therein. In particular, the vibration generator 30 is coupled to the support 44.

The apparatus 10 comprises an arm 32 connecting the vibration generator 30 and the blade 20. The arm 32 is U-shaped (see FIG. 6) to pass aside from the sheet 13 being unwound by the blade 20.

The vibration generator 30 generates specific vibrations on the arm 32. Indeed, the arm 32 is strongly attached to the blade 20 so that the blade 20 vibrates substantially with the same frequency and amplitude that the arm 32 of the vibration generator 30. According to a preferred embodiment, the arm 32 vibrates at ultrasonic speed, meaning it vibrates between about 30 kilohertz and about 35 kilohertz.

Figure 6:
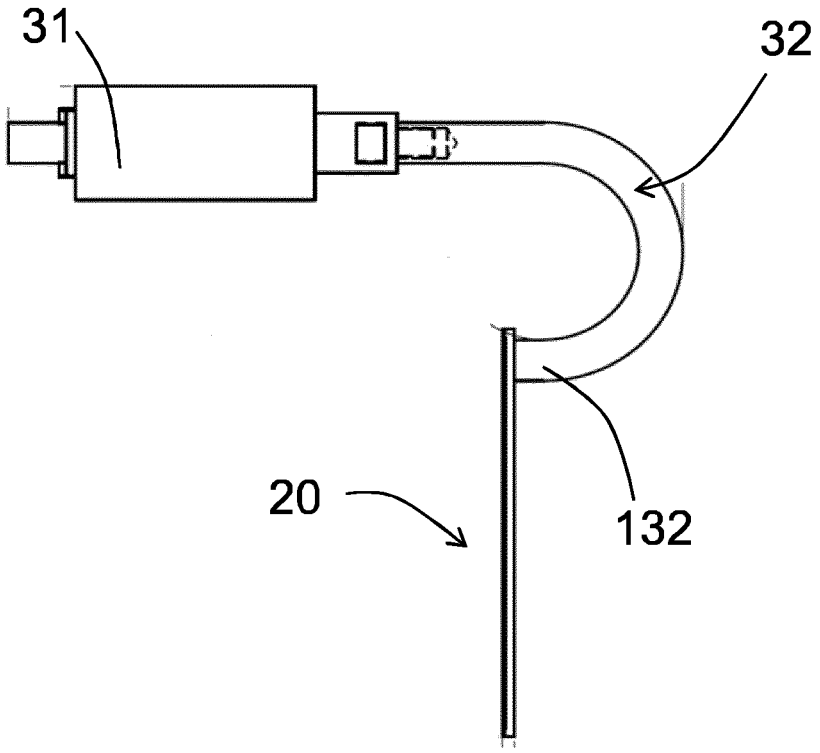
FIG. 6 is a plan view of the portion of the unwinding apparatus of FIG. 5.

In particular, an end portion 132 of the arm 32 is connected to the side 122 of the blade 20 (see FIG. 6). Preferably, the end portion 132 is connected to the blade 20 at or near the edge portion 26 of the blade 20 itself (see FIG. 7). More preferably, the end portion 132 is connected to the blade 20 at a lateral portion of the side 122 (see FIGS. 6 and 7).

In the non-limiting example shown in the figures, the position adjustment system 40 adjusts the position of the blade 20 by adjusting the position of the vibration generator 30 to which the blade 20 is connected.

In this way, the position adjustment system 40 is not in contact with the vibrating arm 32 connected to the vibration generator 30. Therefore the position adjustment system 40 does not interfere with the vibrations generated by the vibration generator 30.

The operation of the unwinding apparatus 10 for unwinding the bobbin 12 is as follows.

The bobbin 12 of the coiled sheet 13 is provided and comprises the free portion 133 of the sheet 13 unwound from the bobbin 12.

The blade 20 is arranged between the free portion 133 of the sheet 13 and the remaining of the sheet 13 coiled in the bobbin 12 in such a way that the blade 20 is in contact to the sheet 13 coiled in the bobbin 12.

The blade 20 is vibrated while unwinding the sheet 13 from the bobbin 12.

Pressure is applied by the blade on the bobbin 12 in the contact region 100 between the blade 20 and the sheet 13 coiled in the bobbin 12.

The free portion 133 of the sheet 13 is pulled while unwinding the bobbin 12.

The above-mentioned pressure is applied on the bobbin 12 by shifting the blade 20 towards the bobbin 12 when a dimension of the bobbin 12 is reduced due to the unwinding.

The blade 20 is vibrated at a frequency comprised between about 30 kilohertz and about 35 kilohertz.

The blade 20 is preferably arranged so that the second end portion 22 of the blade 20 is substantially tangential to the sheet 13 coiled in the bobbin 12 at the contact region 100 between the edge portion 20 and the sheet 13 coiled in the bobbin 12. In particular, the blade 20 is arranged on the bobbin 12 so that the second end portion 22 of the blade 20 is toward the bobbin 12 and somewhat tangential to the bobbin 12. The flat side 121 of the blade 20 is toward the sheet 13 that is being unwound. Such disposition allows limiting the contact surface between the blade 20 and the bobbin 12 which generates friction and heat.

Once in position, the blade 20 (which is vibrating due to the vibration generator 30) applies vibrations at the very specific location where the sheet 13 is being unwound from the bobbin 12. The vibrations of the blade 20 are quite tangential to the bobbin 12 at an unwinding area. Further, the vibrations include a back and forth motion of the blade towards the bobbin.

The vibrating blade 20 transfers to the sheet 13, being unwound from the bobbin 12 but still substantially stuck to it, a controlled amount of force related to the frequency and amplitude of the vibrations.

This amount of force is applied to a limited portion of the sheet 13 due to the specific shape of the tool, that is, of the blade 20.

While the bobbin 12 is unwound, a pulling strength is simultaneously applied to sheet 13.

The blade 20 is moved toward the center 1100 of the bobbin 12 following the unwinding of the bobbin 12 and the shape of the bobbin 12, due to the position adjustment system 40.

The position adjustment system 40 includes control means arranged to automatically move the blade 20 as the bobbin 12 is unwound in a direction towards the rotation axis of the bobbin 12, at a speed equal to a speed of reduction of diameter of the bobbin 12.

The position adjustment system 40 comprises a weight to create by gravity an effort of contact between the blade 20 and the bobbin 12.

The blade 20 is coupled to the ultrasonic generator 30 during unwinding a coiled or rolled sheet 13, in order to prevent adhesion or facilitate detachment between the uncoiled/unrolled sheet 13 and the coil/roll 12.

In other words, the unwinding apparatus 10 is arranged to uncoil/unroll an elongated sheet 13 coiled or rolled to form a bobbin 13. The unwinding apparatus 10 comprises the blade 20 located between the bobbin 12 and a free portion 133 of the unwound elongated sheet 13. The blade 20 is coupled to an ultrasonic generator 30 arranged to vibrate the blade 20 contacting the free portion 133 of the unwound elongated sheet 13.

By using the apparatus 10 of the invention, the occurrences of breakings of the sheet 13 decrease and the yield of the sheet material advantageously increases.

Moreover, the apparatus 10 of the invention limits the heat transferred to the sheet. Therefore, in the case of tobacco cast leaves bobbins 12, the tobacco cast leaves are not damaged.

Furthermore, the apparatus 10 of the invention allows increasing the unwinding speed of the bobbins 12. The Applicant tested the apparatus 10 of the invention on tobacco cast leaves bobbins 12 and found that the unwinding speed can be substantially doubled with respect to the prior art apparatus, for instance from about 100 meters per minute to about 200 meters per minute.

The invention claimed is:

1. A method for unwinding a bobbin of a coiled sheet, the method comprising:

providing a bobbin of a coiled sheet, the bobbin comprising a free portion of the sheet unwound from the bobbin;

arranging a blade between the free portion of the sheet and the remaining of the sheet coiled in the bobbin in such a way that the blade is in contact to the sheet coiled in the bobbin; and vibrating the blade while unwinding the sheet from the bobbin.

2. The method according to claim 1, comprising:

applying pressure on the bobbin in a contact region between the blade and the sheet coiled in the bobbin.

3. The method according to claim 1, comprising:

pulling the free portion of the sheet while unwinding the bobbin.

4. The method according to claim 1, wherein the step of applying pressure comprises:

shifting the blade towards the bobbin when a dimension of the bobbin is reduced due to the unwinding.

5. The method according to claim 1, wherein the step of vibrating the blade comprises:

vibrating the blade at a frequency comprised between about 10 kilohertz and about 100 kilohertz.

6. The method according to claim 1, wherein the step of arranging the blade comprises:

providing a blade having an edge portion; and arranging the blade so that the edge portion of the blade is substantially tangential to the sheet coiled in the bobbin at a contact region between the edge portion and the sheet coiled in the bobbin.

7. An unwinding apparatus for unwinding a bobbin, the apparatus comprising:

a bobbin holder where a bobbin of a coiled sheet is placed;

a blade arranged in front of the bobbin holder and adapted to be in contact to the sheet coiled in the bobbin; and a vibration generator connected to the blade and adapted to put the blade into vibrations while the sheet is unwinding from the bobbin.

8. The unwinding apparatus according to claim 7, wherein the vibration generator is an ultrasonic generator adapted to generate vibrations of the blade between about 10 kilohertz and about 100 kilohertz.

9. The unwinding apparatus according to claim 7, wherein the blade comprises an edge portion adapted to contact the sheet coiled in the bobbin, the edge portion comprising a first and a second surfaces forming an angle therebetween of about 12°±5°.

10. The unwinding apparatus according to claim 7, wherein the blade comprises a body portion adapted to face a free portion of the sheet unwound from the bobbin, the body portion comprising a first and a second surfaces forming an angle therebetween of about 2°±1°.

11. The unwinding apparatus according to claim 7, comprising a position adjustment system, adapted to change the position of the blade with respect to the bobbin holder depending on a dimension of the bobbin present in the holder.

12. The unwinding apparatus according to claim 11, comprising a control unit connected to the position adjustment system and adapted to command the position adjustment system to move the blade towards the bobbin as the dimension of the bobbin reduces due to unwinding.

13. The unwinding apparatus according to claim 11, wherein the position adjustment system includes a rail wherein a support of the blade can slide towards and moving away from the bobbin holder, and a weight to pull the support towards the bobbin holder by gravity.

14. The unwinding apparatus according to claim 13, wherein the vibration generator, connected to the blade, is coupled to the rail so as to slide therein.

15. The unwinding apparatus according to claim 7, wherein the blade is made of polytetrafluoroethylene or comprises a polytetrafluoroethylene coating.

16. The unwinding apparatus according to claim 7, comprising an arm connecting the vibration generator and the blade, the arm having a U-shaped form.

17. The unwinding apparatus according to claim 7, wherein the blade is arranged to be in contact to the sheet coiled in the bobbin substantially tangential to the sheet coiled in the bobbin at a contact region between the blade and the sheet coiled in the bobbin.

* * * * *